US008756728B2

(12) United States Patent
Bergkvist

(10) Patent No.: US 8,756,728 B2
(45) Date of Patent: Jun. 24, 2014

(54) BED FOR INFANTS WITH CRADLE FUNCTION

(75) Inventor: Håkan Bergkvist, Bromma (SE)

(73) Assignee: BabyBjörn AB, Solna (SE)

( * ) Notice: Subject to any disclaimer, the term of this patent is extended or adjusted under 35 U.S.C. 154(b) by 121 days.

(21) Appl. No.: 13/125,909

(22) PCT Filed: Nov. 11, 2009

(86) PCT No.: PCT/SE2009/051286

§ 371 (c)(1),
(2), (4) Date: Apr. 25, 2011

(87) PCT Pub. No.: WO2010/059113

PCT Pub. Date: May 27, 2010

(65) Prior Publication Data

US 2011/0219539 A1 Sep. 15, 2011

(30) Foreign Application Priority Data

Nov. 19, 2008 (SE) ..... 0802427

(51) Int. Cl.
*A47D 9/00* (2006.01)

(52) U.S. Cl.
USPC ..... 5/104; 5/101; 5/105

(58) Field of Classification Search
USPC ..... 5/93.1, 101, 104, 105, 108, 310, 655; 297/181, 258.1, 259.4, 271.5, 271.6, 297/451.7, DIG. 11; 446/486; 482/77
See application file for complete search history.

(56) References Cited

U.S. PATENT DOCUMENTS

| | | | | | |
|---|---|---|---|---|---|
| X6514 | I1 | * | 4/1831 | Harrington | 297/259.4 |
| 128,746 | A | * | 7/1872 | Ordway | 5/104 |
| 158,977 | A | * | 1/1875 | Post | 5/104 |
| 568,293 | A | * | 9/1896 | Blake | 297/259.4 |
| 898,084 | A | * | 9/1908 | Backermann | 36/7.8 |
| 1,069,196 | A | * | 8/1913 | Smith | 5/107 |
| D47,415 | S | * | 6/1915 | Barker | D6/390 |
| 1,260,075 | A | * | 3/1918 | Shaw | 5/104 |
| 1,897,258 | A | * | 2/1933 | Jenne | 5/93.1 |
| 1,941,340 | A | * | 12/1933 | Dellert | 297/239 |
| 2,000,624 | A | * | 5/1935 | Traver | 297/290 |
| 2,567,418 | A | * | 9/1951 | Barker | 297/288 |
| 2,647,268 | A | * | 8/1953 | Lee | 5/104 |
| 2,896,225 | A | * | 7/1959 | Tonkin | 5/109 |
| 2,964,762 | A | * | 12/1960 | Reynolds | 5/109 |
| 2,992,009 | A | * | 7/1961 | Dimitriadis | 280/1.13 |
| 2,995,377 | A | * | 8/1961 | Miihlroth | 280/1.13 |
| 3,195,951 | A | * | 7/1965 | Palmer | 297/260.1 |
| 3,332,718 | A | * | 7/1967 | Reinhold | 297/288 |
| 4,081,869 | A | * | 4/1978 | Ash | 5/105 |
| 4,888,997 | A | * | 12/1989 | Eckert et al. | 73/862.382 |

FOREIGN PATENT DOCUMENTS

DK 298 04 407 U1 8/1998

* cited by examiner

*Primary Examiner* — Nicholas Polito
(74) *Attorney, Agent, or Firm* — Dickstein Shapiro LLP

(57) ABSTRACT

A bed for infants with cradle function comprising a bed structure (1) and legs (3, 4) attached thereto, wherein the bed has two legs (3, 4) mounted to the bed structure (1) diametrically opposite to each other, seen in a longitudinal direction of the bed, that the respective leg (3, 4) has laterally protruding elements (9, 10; 11, 12) made of a resilient material at its free end, and in that said protruding resilient elements (9, 10; 11, 12) are arranged to protrude obliquely downwards from the leg to a floor so that the lower part of the leg is situated at a distance from said floor.

10 Claims, 1 Drawing Sheet

BED FOR INFANTS WITH CRADLE FUNCTION

FIELD OF INVENTION

Figure 1:
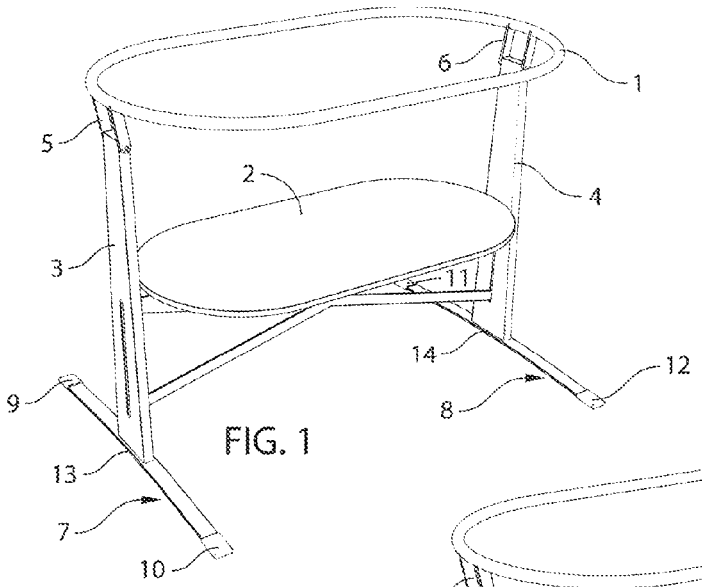

The present invention relates to a bed for infants with cradle function comprising a bed structure and legs connected thereto.

PRIOR ART

Conventional cradles are normally built up with longitudinal or transverse rockers. The cradle can then be rocked in a predetermined direction/course. Another type of cradle existing on the market is a basket suspended in cords in for example a hook in the ceiling. This type of cradle can be rocked in a 360° determined course.

It is often spoken about parents being forced to put the infant in the pram and push it backwards and forwards over a threshold in order to get the infant to fall asleep, children who only fall asleep when they ride in a car, or even children falling asleep lying on a spin-drying washing machine. Our researches of why children tend to fall sound asleep in these environments led to the conclusion that the movements generated by a pram, a car or a spin-drying washing machine, describe a stochastic movement in several dimensions, which seems to affect the falling asleep of the child in a positive way.

A use of helical coils between the legs of the bed and the floor has been tested earlier and such equipment they say can be bought as accessories in order to accomplish a cradle function of a child's bed. Various tests with helical coils have not given any good results with the base we have chosen as maximum base. The cradle then performed too bumpy. In order to obtain a movement which is pleasant for the child very long protruding bars are required, on which soft springs are attached, but then the product has grown so much that it cannot be moved in a home, and it will also be a troublesome hindrance in the room where it stands.

THE OBJECT OF THE INVENTION

The object of the present invention is accordingly to provide a bed for infants with a cradle function, which gives rise to three dimensional stochastic movements with an harmonic character, i.e. not too quick or bumpy, since this negatively affect the falling asleep of the child, and thus relieves the parents of the burden to drive around in their car at night, pushing the pram backwards and forwards over a threshold or other similar desperate actions to get the child to fall asleep. In contrast to conventional cradles constructed according to the prior art, the object of the invention is to imitate already known effective methods for falling asleep, such as riding in a car car, pushing a pram over a threshold etc.

SHORT SUMMARY OF THE INVENTION

These and other objects are achieved with the present invention.

By using elongated spring elements, which extend in opposite directions from a leg, a very advantageous spring characteristic is obtained for this product. The movement of the spring element under stress can be described as waved, which is also optimal for a cradle. By adapting length, thickness, width and a certain bias an harmonic movement in three dimensions is obtained, which affect the child's falling asleep positively. When the child itself moves the bed will begin to move. This leads to that the child itself can rock itself to sleep by using the spring elements according to the invention. A base can also be achieved which is stable enough to fulfill existing product standards (tipping over) and still with a limited width, resulting in that the infant bed easily can be moved around in a home.

With a suitable choice of material the spring elements can be made short enough, so that the bed without problems can be moved through a door opening, does not stand in the way but still has a size that make the risk for tipping over to be minimal, and the existing safety regulations are fulfilled. As has been noted above, this is not possible when using coil springs.

One further positive effect with the spring elements according to the invention is that their ends will be lying adjacent to the floor, which minimizes the risk for hurting toes or feet on the protruding legs.

With the suggested design a very simple construction is obtained, since the spring elements partly constitute feet (part of the supporting structure) and at the same time constitutes the springing element. This enables an inexpensive and expedient design and production. By designing the spring elements demountable the size of a package containing the bed can easily be reduced at shipment.

"Elongated springing element" is to be interpreted in a wide sense. In the present description is also comprised a structure in which a wire or rod has been bent into a loop-like form and wherein the loops are arranged to extend outwards in opposite directions from a leg, a bent band made of a resilient material, as well as two spring elements which extend outwards in opposite directions from the leg.

According to a variant of the invention the elongate spring element consists of one single element, which in its middle part is mounted in the respective leg, and which is bent in such a way that on each side of the leg protruding parts runs at an angle from the leg down towards the floor, resulting in that the lower end of the leg will be situated at a distance above the floor, and said springing effect will be achieved.

According to an alternative variant two elongated springing elements are used at each leg, arranged in such a way that they extend outwards at an angle from the leg down towards the floor. Thereby the lower end of the leg may be angled in order to give the correct angle position when mounting straight elongated spring elements. Alternatively, the respective spring element may be bent or curved with a desired angle in order to be mounted on a straight lower edge of the leg to be placed in a desired angle.

SHORT DESCRIPTION OF THE DRAWINGS

Figure 2:
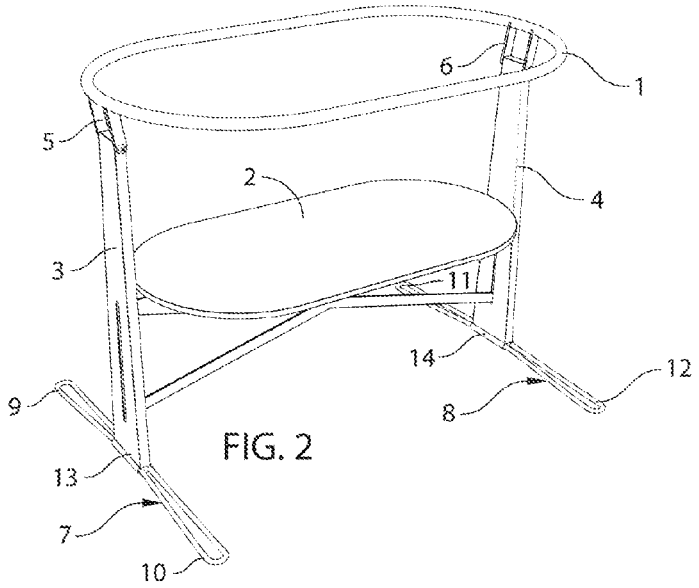
Figure 3:
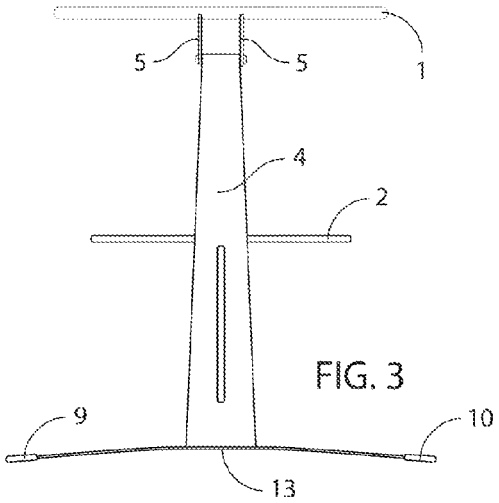

Further objects, features and advantages of the invention will be evident from the following detailed description of the invention with reference to the accompanying drawings, on which FIG. 1 shows a view in perspective of a bed for infants according to one embodiment of the invention, FIG. 2 shows a view corresponding to the view in FIG. 1 of an alternative embodiment of the invention, and FIG. 3 shows a partial end view of the bed for infants according to the invention.

DETAILED DESCRIPTION OF THE INVENTION

The invention will now be described more in detail with reference to the embodiments of the invention shown in the drawings.

In FIG. 1 is shown a bed for infants according to the invention in the form of a frame consisting of a rim 1, a bed bottom 2, legs 3, 4 which are connected to the rim 1 through fastening means 5,6, seen in a longitudinal direction of the bed, diametrically opposite to each other. It should be noted that the structure of the bed, wherein the infant shall lie, does not constitute a part of the present invention. The legs have a certain extension in the width direction, which will be discussed further below. At the lower part in the embodiment shown in the drawing the respective leg has feet in the form of elongated springing elements 7, 8, arranged to protrude substantially equally long on each side of the respective leg. Said elongated springing elements are designed curved so that when their respective ends 9, 10 and 11, 12 rests on a floor, their respective central parts 13, 14, which are mounted in the respective leg 3, 4, are at a distance from said floor.

The elongated springing elements 7, 8 are mounted in the underside of the respective leg 3, 4. Since the legs have an extension in the width direction said elements can be stably mounted in the legs. In that respect, the elongated springing elements can be screwed to the legs so that they can easily be demounted in case the bed shall be put aside or be transported. This is also advantageous during storage and selling, since the bed can then be packed and distributed as flat packages.

Said elongated springing elements consist preferably of a resilient material, such as a spring steel or a hard plastic material with resilient characteristics e.g. in the form of a homogenous strip material or a bent wire material such as illustrated in FIGS. 1 and 2.

With this leg construction is obtained a flexible and light structure, which thanks to the design of the feet is very stable while at the same time the design of the feet gives the desired cradle movements. The cradle movements are affected by choice of material, dimensions and also of the angle of the bending or the curve for the elongate springing elements. By choosing a material with a high E module the feet can be made thin, which reduces the risk for that persons moving around the cradle hit against these and hurt themselves or fall.

By variation of the characteristics of the material the length of the feet can be optimized. The longer the feet are, the less will the risk be for the cradle to tip over. On the other hand it becomes more cumbersome with long feet and it will be difficult to move the bed through e.g. door openings. Further, the feet will also be more in the way. The total extension of the feet can be for example about 600 mm, which gives a high safety against tipping over while at the same time the cradle without much problems can be lifted through door openings.

A man skilled in the art can choose a material with suitable characteristics. This material can for example be spring steel or alternatively a hard plastic material, which can be reinforced, for example with glass fibre and/or carbon fibre, wood, such as bentwood, and the like. The material used shall not give rise to any permanent deformation when loaded.

In the drawings is shown a presently preferred embodiment of the invention. Accordingly, the elongated spring elements forming the feet of the bed are shown as one single element at the respective leg. Since the part situated in the middle, which also forms the part to be mounted to the leg, does not take part in the work by the springs, the same effect is obtained as if instead of one element is used two springing elements, which are mounted in the leg at one end while the other end is a foot which is in contact with the floor. The angle adjustment can then be accomplished by designing the lower edge of the leg substantially as a V with the desired inclination of the shanks. Alternatively the spring elements can be bent so that they upon mounting on the straight lower edge of the leg obtains the desired angular position.

The mounting of the spring elements in the legs of the bed can be arranged in different ways. Thus the spring elements can be arranged demountable in simple operations in a bracket sitting on the leg, e.g. with a snap fastener, a locking screw and the like.

It should also be emphasized that with the wording "bent elements" are also comprises curved elements, which do not have a distinct bending site. It is also conceivable that the spring elements are double curved in such a way they from the leg are curved away from the bed, which curving towards the end of the spring element is transformed into a counter curve, which might have another curve radius. With this last mentioned variant the contact surface with the floor will be bigger, and there is also a more gentle transition to the floor so that the risk for damages of the floor is minimized.

The invention claimed is:

1. A bed for an infant, the bed having a cradle function, and wherein the bed comprises:

a bed structure having a bed bottom and a rim, the bed bottom being configured to support the infant while the infant is sleeping, the rim being located above the bed bottom such that, while the infant is sleeping, the infant is located in the bed structure, above the bed bottom, and below the rim; and two legs attached to the bed structure, wherein the legs are mounted to the bed structure diametrically opposite to each other, seen in a longitudinal direction of the bed, the bed having a length in the longitudinal direction and a width in a lateral direction of the bed, the length of the bed being greater than the width of the bed, and the length direction of the bed being perpendicular to the lateral direction of the bed; and wherein the legs have lower ends, and wherein the bed bottom of the bed structure is located above the lower ends of the legs;

wherein the bed further includes laterally protruding elements made of a resilient material, wherein the laterally protruding resilient elements have central portions, and wherein the central portions are connected to the lower ends of the legs;

wherein said protruding resilient elements are arranged to protrude obliquely downwards from the lower ends of the legs to a floor so that the lower ends of the legs are situated at a distance from said floor to obtain a harmonic movement of the bed in three dimensions, and wherein the harmonic movement of the bed includes vertical movement of the bed bottom relative to the floor; and wherein each laterally protruding resilient element has two feet, wherein the lower ends of the legs are supported only by the protruding resilient elements, and wherein only the feet of the laterally protruding resilient elements contact the floor while the infant is sleeping.

2. The bed according to claim 1, wherein each of the respective legs is connected to an elongated springing element in the middle thereof so that free protruding parts are protruding laterally substantially equally on each side of the respective leg.

3. The bed according to claim 1, wherein each of the respective legs is connected to two elongated spring elements arranged to protrude equally on each side of the respective leg and at an angle towards a floor.

4. The bed according to claim 2, wherein the elongated springing elements are manufactured of a strip material, and wherein each laterally protruding resilient element has a double curve configuration between the central portions and the feet, such that the feet lie flat on the floor to avoid hurting toes or feet of an operator.

5. The bed according to claim 2, wherein the elongated springing elements are manufactured of a wire material.

6. The bed according to claim 2, wherein said elongated springing elements are manufactured from steel.

7. The bed according to claim 2, wherein said elongated springing elements are manufactured from spring steel.

8. The bed according to claim 2, wherein the elongated springing elements are manufactured from a material with resilient characteristics.

9. The bed according to claim 8, wherein the elongated springing elements are manufactured from a material selected from the group consisting of wood and plastic.

10. The bed according to claim 9, wherein the elongated springing elements are manufactured from plastic which is reinforced with a material selected from the group consisting of glass fiber and carbon fiber.

* * * * *